US007816607B2

(12) United States Patent
Belli et al.

(10) Patent No.: US 7,816,607 B2
(45) **Date of Patent: *Oct. 19, 2010**

(54) PROCESS FOR THE PRODUCTION OF A MULTIPOLAR CABLE, AND MULTIPOLAR CABLE PRODUCED THEREFROM

(75) Inventors: Sergio Belli, Leghorn (IT); Alberto Bareggi, Milan (IT); Paolo Veggetti, Monza (IT); Luca Balconi, Bresso (IT); Paolo Bossi, Arona (IT)

(73) Assignee: Prysmian Cavi E Sistemi Energia S.R.L., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 12/268,602

(22) Filed: Nov. 11, 2008

(65) Prior Publication Data

US 2009/0071692 A1 Mar. 19, 2009

Related U.S. Application Data

(63) Continuation of application No. 10/432,890, filed as application No. PCT/EP01/13579 on Nov. 22, 2001, now Pat. No. 7,465,880.

(60) Provisional application No. 60/251,870, filed on Dec. 8, 2000.

(30) Foreign Application Priority Data

Nov. 30, 2000 (EP) ..... 00126132

(51) Int. Cl.
*H01B 7/00* (2006.01)

(52) U.S. Cl. ..... 174/120 R

(58) Field of Classification Search ..... 174/110 F, 174/113 R, 116, 120 R
See application file for complete search history.

(56) References Cited

U.S. PATENT DOCUMENTS 3,155,768 A 11/1964 Garshick (Continued)

FOREIGN PATENT DOCUMENTS

DE 1515709 6/1969

(Continued)

OTHER PUBLICATIONS

Office Action issued in U.S. Appl. No. 10/432,890, Mailing Date: Aug. 22, 2005.

(Continued)

*Primary Examiner*—Chau N Nguyen
(74) *Attorney, Agent, or Firm*—Finnegan, Henderson, Farabow, Garrett & Dunner, L.L.P.

(57) ABSTRACT

A process for manufacturing a multipolar cable having at least one pair of cores, each core having at least one conductive element and at least one layer of electrical insulation in a position which is radially external to the at least one conductive element. The process includes the steps of: a) assembling the at least one pair of cores so as to form an assembled element having a plurality of interstitial zones between the cores, and b) depositing by co-extrusion an expandable polymeric material in a position which is radially external to the cores so as to fill the interstitial zone and to form a filling layer of substantially circular transverse cross section, and at least one containment layer of polymeric material in a position radially external to the filling layer. The multipolar cable obtained from the process.

9 Claims, 2 Drawing Sheets

U.S. PATENT DOCUMENTS

| | | | | |
|---|---|---|---|---|
| 4,104,210 | A | 8/1978 | Coran et al. | |
| 4,399,319 | A | 8/1983 | Zinn | |
| 4,789,589 | A | 12/1988 | Baxter | |
| 4,916,198 | A | 4/1990 | Scheve et al. | |
| 5,183,212 | A * | 2/1993 | Boo et al. | 241/17 |
| 5,457,285 | A | 10/1995 | Faust et al. | |
| 6,264,069 | B1 * | 7/2001 | Hughes et al. | 222/129.1 |
| 6,317,540 | B1 * | 11/2001 | Foulger et al. | 385/100 |

FOREIGN PATENT DOCUMENTS

| | | | |
|---|---|---|---|
| DE | 8103947.6 | U1 | 12/1989 |
| DE | 9216118.9 | U1 | 4/1993 |
| EP | 0 324 430 | A1 | 7/1989 |
| WO | WO 98/52197 | A1 | 11/1998 |
| WO | WO 99/33070 | A1 | 7/1999 |

OTHER PUBLICATIONS

Office Action issued in U.S. Appl. No. 10/432,890, Mailing Date: Mar. 10, 2006.
Office Action issued in U.S. Appl. No. 10/432,890, Mailing Date: Jul. 2, 2007.
Office Action issued in U.S. Appl. No. 10/432,890, Mailing Date: Dec. 21, 2007.
Notice of Allowance issued in U.S. Appl. No. 10/432,890, Mailing Date: Aug. 15, 2008.
Declaration of Alberto Bareggi as filed in European Application No. 01 989 502.8-1218, dated Nov. 14, 2005.
International Search Report issued in PCT/EP01/13579 (WO 02/45100), mailed on Apr. 24, 2002.
Translation of text of DE 1515709.
Translation of text of DE 8103947.6 U1.
Translation of text of DE 9216118.9 U1.

* cited by examiner

PROCESS FOR THE PRODUCTION OF A MULTIPOLAR CABLE, AND MULTIPOLAR CABLE PRODUCED THEREFROM

CROSS REFERENCE TO RELATED APPLICATIONS

This is a continuation of U.S. application Ser. No. 10/432,890, filed Nov. 5, 2003 now U.S. Pat. No. 7,465,880, which is a national phase application based on International Application No. PCT/EP01/13579, filed Nov. 22, 2001, which claims priority to European Patent Application No. 00126132.0 filed Nov. 30, 2000, and claims the benefit of U.S. Provisional Application No. 60/251,870 filed Dec. 8, 2000, the contents of all of which are incorporated herein by reference.

BACKGROUND OF THE INVENTION

1. Field of the Invention

The present invention relates to a process for the production of a multipolar cable, in particular a multipolar cable for the transport or distribution of low or medium voltage electrical power.

Furthermore, the present invention relates to a multipolar cable, in particular a multipolar cable for the transport or distribution of low or medium voltage electrical power.

In the present description the term "low voltage" means a voltage below approximately 1 kV, the term "medium voltage" means a voltage between approximately 1 kV and approximately 30 kV, and the term "high voltage" means a voltage in excess of approximately 30 kV.

In the present description and in the claims which follow the term "core" of the cable means a semi-finite structure comprising a conductive element and at least one layer of electrical insulation placed in a position which is radially external to said conductive element. More particularly, when considering a cable for the transport or distribution of medium/high voltage electrical power, said "core" also comprises an internal semiconductive covering located in a position which is radially external to the conductive element, an external semiconductive covering located in a position which is radially external to the layer of electrical insulation and a metal screen in a position which is radially external to said external semiconductive covering.

Furthermore, for the purposes of the present description and the claims which follow, the term "multipolar cable" means a cable provided with at least a pair of "cores" as defined above. In greater detail, if the multipolar cable has a number of cores equal to two said cable is technically defined by using the term "bipolar cable", and if the cores number three said cable is known as a "tripolar cable", and so on.

The aforesaid cores, in a number which is predetermined according to the desired multipolar cable, once obtained are joined together to form a so-called "assembled element".

In the present description and in the claims which follow the term "assembled element" of a multipolar cable means a composite structure formed from the cores possessed by that cable. Preferably such a composite structure is obtained by helicoidally winding said cores together according to a predetermined pitch.

As a result of its nature, in that it is obtained by winding at least one pair of cores together, said assembled element has a plurality of interstitial zones which are defined by the spaces comprised between the cores. In other words, the winding of said cores gives rise to a plurality of voids, i.e. the interstitial zones, which, in a transverse cross section along the longitudinal length of the assembled element, define an external perimetral profile of the latter of non-circular type.

Therefore, in order to allow the correct application of the successive layers possessed by the multipolar cable, in a position which is radially external to said assembled element, the production process for a multipolar cable comprises the step of filling said interstitial zones so as to confer to the assembled element a regular transverse cross section, preferably of the circular type.

Said interstitial zones, which are also known with the term "star areas", are generally filled with a filler of the conventional type, for example a polymeric material applied by extrusion.

Once said filling step has been completed and the semi-finished multipolar cable obtained so far is given a transverse cross section of the circular type, said cable is finished off with the application of at least a further layer, the nature of which, as well as the number of layers which can be used, depend on the type of multipolar cable to be obtained.

2. Description of Related Art

For example, in accordance with a construction scheme of the conventional type performed by using techniques known in the art, in a radial position external to the aforesaid semi-finished cable obtained so far, it is possible to apply, in succession, a metal reinforcement (for example in the form of metal tapes or wires, generally made of steel, or in the form of a metal sheath, generally made of lead or aluminium) and an external polymeric sheath. In some cases the application of the metal reinforcement is preceded by the application of an inner polymeric sheath suitable to provide the assembled element with a mechanical protection from the metal reinforcement.

In accordance with a further form of embodiment, described in patent application WO 98/52197 in the name of the Applicant, a layer of expanded polymeric material of a suitable thickness can be applied in a position which is radially external to the aforesaid semi-finished cable obtained so far, said layer of expanded polymeric material being capable of conferring upon the aforesaid cable a high resistance to accidental impacts which might be suffered by the latter during the steps of cable transport or laying. In fact, said impacts can cause considerable damage to the cable structure (for example deformation of the insulating layer, detachment of the cable layers) determining, for example, changes in the electrical gradient of the insulating layer with a consequent reduction in its insulating capacity.

Furthermore, generally an external polymeric sheath suitable to confer to the cable a greater mechanical protection from the external environment is applied, according to known techniques, in a position which is radially external to said layer of expanded polymeric material.

Moreover, document WO 98/52197 cited above provides for the possibility of filling the aforesaid interstitial zones with an expanded polymeric material, similar to that which is used for a layer resistant to accidental impacts as illustrated above, instead of a conventional filler.

In fact, according to the Applicant, said embodiment presents some important advantages.

First of all, the use of an, expanded polymeric material makes it possible to obtain a cable which is lighter than a similar cable whose interstitial zones are filled with a conventional filler.

Said aspect is very much more than negligible in that the possibility of providing for a cable which is lighter than a conventional one is reflected in greater ease of transport, and consequently in reduced transport costs, as well as in easier, handling of the cable during the laying step. In this respect it is worthwhile emphasising that the less the overall weight of the cable to be installed (for example directly in a trench excavated into the ground or in a buried piping), the less will be the pulling force which is necessary to be applied to the cable in order to install it. Therefore, this means both lower installation costs and greater simplicity of the installation operations.

A second advantage is provided by the fact that the use of an expanded polymeric material in a radially internal position in the structure of the multipolar cable, i.e. in the aforesaid interstitial zones of the assembled element, as well as in a portion of the cable which is closer to its external surface, helps to confer to the cable itself a greater mechanical protection, i.e. a greater mechanical resistance to accidental impacts as defined above.

A further advantage lies in the fact that the use of an expanded polymeric material to replace a conventional filler helps to increase the flexibility of the cable, a fact which, once again, reflects in improved handling of the cable, with advantageous repercussions, as already mentioned, particularly during its installation.

However, the Applicant is of the opinion that applying an expandable polymeric material to the interstitial zones of the assembled element possessed by a multipolar cable is a complex operation which requires special care. In fact, an incorrect application of said material inside of the interstitial zones of the assembled element will result in the occurrence of unacceptable structural irregularities of the cable.

More particularly, the Applicant has found that the application of an expandable polymeric material and its expansion on a surface having an external perimetral profile of the non-circular type causes an irregular expansion of said material, and this tends to expand more in some zones than in others.

In other words, the polymeric material tends to expand more where there is more space available to do so.

For example, in the case a tripolar cable is considered, the assembled element, formed by the helicoidal winding of three separate cores, has three interstitial zones having cross sections of a substantially triangular shape, the base of each triangle being directed towards the extrados of the assembled element while the remaining two sides of said triangle are defined by the external profile of two adjacent cores of the cable. In this configuration, the polymeric material, which is designed to fill the interstitial zones and which is applied by extrusion in a position radially external to the assembled element, expands more in the portion of the interstitial zone which is closest to the base of the abovementioned triangle since in correspondence with said base the polymeric material has the most space available to expand.

Non-uniform expansion of the polymeric material within each interstitial zone, i.e. at the extrados of the assembled element, confers to the semi-finished cable obtained hitherto, that is the assembled element plus the filler in the interstitial zones, a transverse cross section of irregular type, in that it has a plurality of protuberances, which in some cases are even very pronounced, where expansion of the polymeric material has been greatest.

For example, in the case of the tripolar cable mentioned above, the transverse cross section of the semi-finished cable obtained so far has an external perimetral profile which is substantially trilobate, the greater curvature of each lobe being located in correspondence of the triangle base defined above.

The occurrence of such a phenomenon is particularly undesirable as it brings about a plurality of disadvantages.

First of all, obtaining an assembled element which has an external perimetral profile of the non-circular type in a transverse cross section means that the layers which are subsequently applied in a position radially external to said assembled element, regardless of the nature of the multipolar cable to be produced, whether of the conventional type or as described in the abovementioned patent application WO 98/52197, will follow said non-circular external perimetral profile and thus result in the production of a finished cable; having an irregular transverse cross section.

This result, apart from being unacceptable for the market from the purely aesthetic point of view, gives rise to a plurality of problems of a practical nature both during cable installation and storage. In the latter case many problems (larger dimensions, less loading capacity, instability of the turns wound on a spool) which might arise during a conventional operation of winding a cable of non-circular cross; section can for example be envisaged.

A further disadvantage lies in the fact that a non-homogeneous distribution of the interstitial zones of the expanded polymeric material gives rise to the formation of zones which contain a greater concentration of material than other less well-endowed zones. Therefore, this means that said zones which are less well-endowed on the one hand show less mechanical resistance to impacts than the zones containing more material, and that, having a lesser thickness, they may be subjected to possible tearing during the extrusion step (more specifically at the exit from the extruder dies), said aspect causing the underlying assembled element to be exposed and consequently the formation of a non-circular transverse cross section of the cable obtained so far.

The Applicant has also found that, on the basis of the teaching provided by document WO 98/52197 mentioned above, whenever it is desired to proceed, with the same extrusion of expandable polymeric material, either to the filling the interstitial zones of the assembled element or the production of a layer resistant to accidental impacts, a non-uniform expansion of said material is obtained which inevitably causes the formation of a multipolar cable having a transverse cross section with an irregular external perimetral profile.

SUMMARY OF THE INVENTION

The Applicant has therefore perceived the need to control the expansion of the polymeric material during the extrusion step of the latter within the interstitial zones of the assembled element of a multipolar cable so that said assembled element, and consequently the finished multipolar cable containing it, can have in transverse cross section an external perimetral profile of the regular type, as far as possible of circular conformation.

The Applicant has found that it is possible to achieve an optimum control of the expansion of the polymeric material designed to fill the interstitial zones in the assembled element of a multipolar cable by depositing said filler made of expandable polymeric material by co-extrusion with a containment layer of polymeric material.

In particular, the Applicant has found that said containment layer has to be co-extruded in a position radially external to the filling layer in order to achieve a uniform distribution of the expandable polymeric material within said interstitial zones avoiding a greater expansion in some zones rather than in others.

The present invention is advantageously applicable not only to electrical cables for the transport or distribution of power, but also to cables of the mixed power/telecommunications type which include an optical fibre core. In this sense, therefore, in the rest of the present description and in the claims which follow the term "conductive element" means a conductor of the metal type or of the mixed electrical/optical type.

Thus in a first aspect the present invention relates to a manufacturing process of a multipolar cable comprising at least one pair of cores, each core comprising at least one conductive element and at least one layer of electrical insulation in a position which is radially external to said at least one conductive element, said process comprising the steps of:

a) assembling said at least one pair of cores so as to form an assembled element provided with a plurality of interstitial zones between said cores, and b) depositing by co-extrusion:

an expandable polymeric material in a position radially external to said cores so as to fill said interstitial zones and to form a filling layer of substantially circular transverse cross section, and at least one containment layer of polymeric material in a position radially external to said filling layer.

In its second aspect the present invention relates to a multipolar cable comprising at least one pair of cores, each core comprising at least one conductive element and at least one layer of electrical insulation in a position radially external to said at least one conductive element, said cores being wound together so as to form an assembled element provided with a plurality of interstitial zones between said cores, said interstitial zones being filled with an expanded polymeric material to form a filling layer, said expanded polymeric material being co-extruded with at least one containment layer of polymeric material located in a position radially external to said filling layer.

BRIEF DESCRIPTION OF THE DRAWINGS

The description below relates to the appended drawings which are provided for solely explanatory purposes and without any restrictive intent, in which.

DETAILED DESCRIPTION OF THE INVENTION

Figure 1:
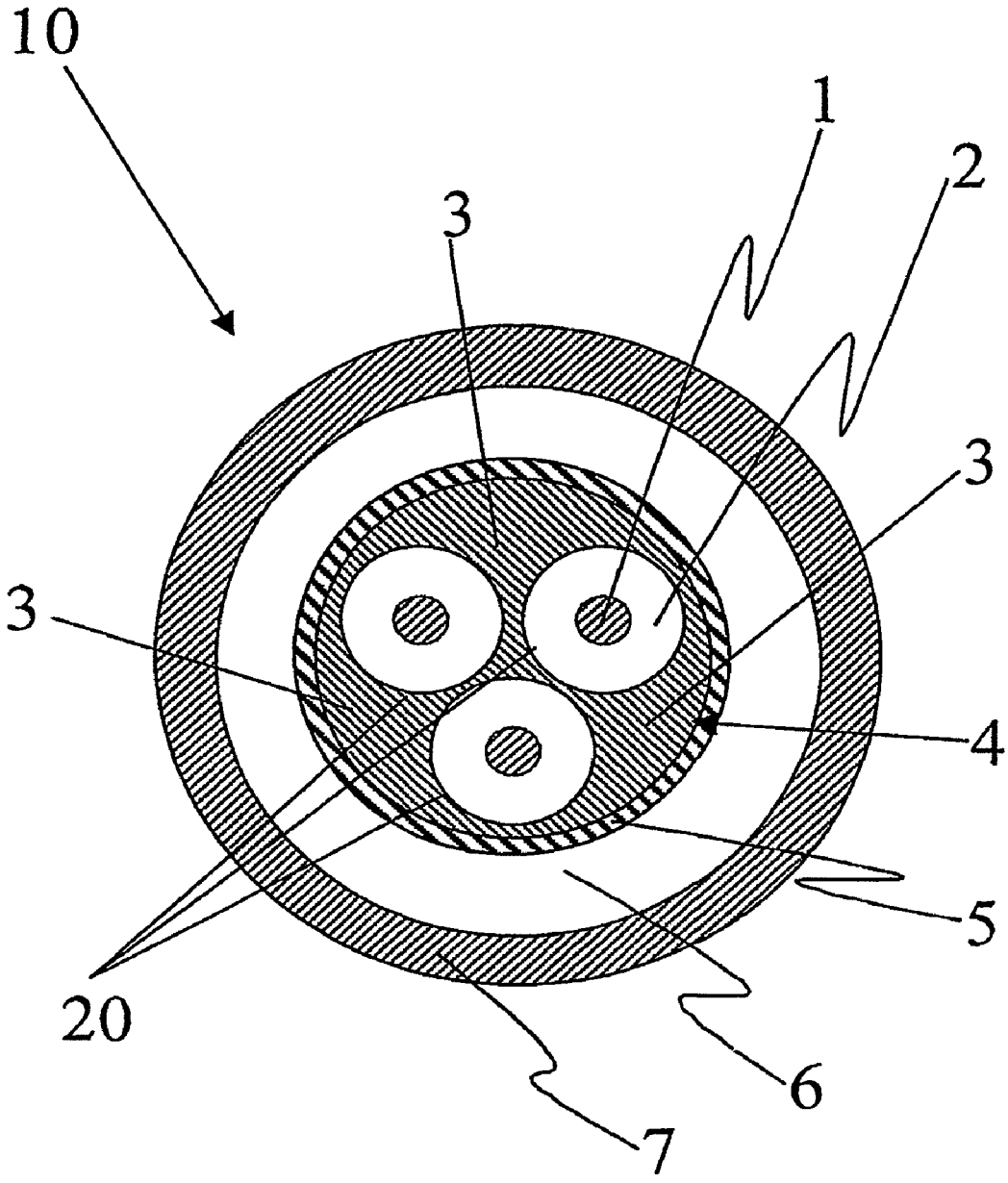
FIG. 1 is a view in right cross section of a particular embodiment of a tripolar electrical cable for the transport or distribution of low voltage power according to the invention.

By the term "expanded polymeric material" in the following of the present description and in the claims which follow is meant a polymeric material having a predetermined percentage of "free" space within the material, that is a space which is not occupied by the polymeric material, but by gas or air.

In general, this percentage of free space in an expanded polymer is expressed by the so-called "expansion degree" (G), defined as follows:

$$G=(d_0/d_e-1)\times 100$$

where $d_0$ indicates the density of the unexpanded polymer and $d_e$ represents the measured apparent density of the expanded polymer.

In accordance with the present invention the expanded polymeric material can be selected from the group comprising: polyolefins, copolymers of different olefins, unsaturated olefin/ester copolymers, polyesters, polycarbonates, polysulphones, phenolic resins, ureic resins, and mixtures thereof. Examples of preferred polymers are: polyethylene (PE), especially low density polyethylene (LDPE), medium density PE (MDPE), high density PE (HDPE) and linear low density PE (LLDPE); polypropylene (PP); ethylene-propylene elastomer copolymers (EPR) or ethylene-propylene-diene terpolymers (EPDM); natural rubber; butyl rubber; ethylene/vinyl ester copolymers, fox example ethylene/vinyl acetate (EVA); ethylene/acrylate copolymers, in particular ethylene/methyl acrylate (EMA), ethylene/ethyl acrylate (EEA), ethylene/butyl acrylate (EBA); ethylene/α-olefin thermoplastic copolymers; polystyrene; acrylonitrile-butadiene-styrene resins (ABS); halogenated polymers, in particular polyvinyl chloride (PVC); polyurethane (PUR); polyamides; aromatic polyesters, such as polyethylene terephthalate (PET) or polybutylene terephthalate (PBT); and copolymers or mechanical mixtures thereof.

Preferably the polymeric material is a polyolefin polymer or copolymer based on ethylene and/or propylene, and in particular is selected from:

(a) ethylene copolymers having an ethylenically unsaturated ester, for example vinyl acetate or butyl acetate, in which the quantity of unsaturated ester is generally comprised between 5% and 80% by weight, preferably between 10% and 50% by weight;

(b) elastomer copolymers of ethylene with at least one $C_3$-$C_{12}$ α-olefin, and optionally a diene, preferably ethylene-propylene copolymers (EPR) or ethylene-propylene-diene copolymers (EPDM) having preferably the following composition: 35%-90% as moles of ethylene, 10%-65% as moles of α-olefin, 0%-10% as moles of diene (for example 1,4-hexadiene or 5-ethyledene-2-norbornene);

(c) ethylene copolymers with at least one $C_4$-$C_{12}$ α-olefin, preferably 1-hexene, 1-octene and the like, and optionally a diene, said copolymers generally having a density between 0.86 g/cm$^3$ and 0.90 g/cm$^3$ and the following composition: 75%-97% as moles of ethylene, 3%-25% as moles of α-olefin, 0%-5% as moles of a diene;

(d) polypropylene modified with ethylene/$C_3$-$C_{12}$ α-olefin copolymers, where the ratio by weight between polypropylene and the ethylene/$C_3$-$C_{12}$ α-olefin copolymer is comprised between 90/10 and 30/70, preferably between 50/50 and 30/70.

For example, class (a) includes the commercial products Elvax® (Du Pont), Levapren® (Bayer), Lotryl® (Elf-Atochem), class (b) includes the products Dutral® (Enichem) or Nordel® (Dow-Du Pont), and class (c) includes the products Engage® (Dow-Du Pont) or Exact® (Exxon), while polypropylene modified with ethylene/α-olefin copolymers can be found on the market under the trade names Moplen® or Hifax® (Montell) or Fina-Pro® (Fina), and the like.

In class (d), thermoplastic elastomers comprising a continuous matrix of a thermoplastic polymer, for example polypropylene, and small particles (generally having a diameter of the order of 1-10 μm) of a vulcanised elastomeric polymer, for example cross-linked EPR or EPDM dispersed in the thermoplastic matrix are especially preferred. The elastomeric polymer can be incorporated in the thermoplastic matrix, in the unvulcanized state and then dynamically cross-linked during the process by the addition of a suitable quantity of cross-linking agent. Alternatively, the elastomeric polymer may be vulcanised separately and then dispersed in the thermoplastic matrix in the form of small particles. Thermoplastic elastomers of this type are described, for example, in documents U.S. Pat. No. 4,104,210 or EP-324,430.

Among the polymeric materials a polypropylene having high mechanical strength in the molten state (high melt strength polypropylene), as described for example in U.S. Pat. No. 4,916,198, which is commercially available under the trade mark Profax® (Montell S.p.A.) is especially preferred. This document illustrates a production process of said polypropylene by a step of irradiating a linear polypropylene with high energy ionising radiation for a sufficient length of time to bring about the formation of a significant quantity of long branches in the chain, after which step there is also provided a suitable treatment of the irradiated material to deactivate the free radicals present in the irradiated material.

Even more preferably, among the polymeric materials a polymeric composition comprising the aforesaid polypropylene with a high level of branching, in a quantity generally comprised between 30% and 70% by weight, in a mixture with a thermoplastic elastomer of the type belonging to class (d) mentioned above, in a quantity generally comprised between 30% and 70% by weight, said percentages being expressed with respect to the total weight of the polymeric composition, is especially favoured.

An electrical cable 10 for the transport of low voltage power according to the present invention is illustrated in right cross section in FIG. 1.

Said cable 10 is of the tripolar type and comprises three conductive elements 1, each covered with a layer 2 acting as an electrical insulator. As mentioned above, said semi-finished structure is referred to by the term core.

Said insulating layer 2 can be a cross-linked or non-cross-linked polymeric composition, with electrical insulating properties known in the art, for example selected from: polyolefins (homopolymers or copolymers of different olefins), olefin/ethylenically unsaturated ester copolymers, polyesters, polyethers, polyether/polyester copolymers and mixtures thereof. Examples of said polymers are: polyethylene (PE), in particular linear low density PE (LLDPE); polypropylene (PP); thermoplastic propylene/ethylene copolymers; ethylene-propylene rubbers (EPR) or ethylene-propylene-diene rubbers (EPDM); natural rubbers; butyl rubbers; ethylene/vinyl acetate copolymers (EVA); ethylene/methyl acrylate copolymers (EMA); ethylene/ethyl acrylate copolymers (EEA); ethylene/butyl acrylate copolymers (EBA); ethylene/1-olefin copolymers, and the like.

With reference to FIG. 1, the three cores are wound together helicoidally to form an assembled element 20 as defined above.

As already mentioned, the helicoidal winding of the three cores of tripolar cable 10 gives rise to the formation of three separate interstitial zones 3 which, in accordance with the present invention and as described in greater detail below, are filled with an expandable polymeric material selected from the polymers mentioned above. In the following of the present description said interstitial zones 3 filled with said expanded polymeric material as a filler will be defined for greater simplicity of description by using the term "filling layer", indicated as a whole by reference sign 4.

Cable 10 according to the present invention also comprises a containment layer 5 produced by co-extrusion with the filling layer 4 and arranged in a position radially external to the latter so as to confer a substantially circular transverse cross section to said filling layer 4.

Said containment layer 5 is made of a polymeric material selected from the group mentioned above with reference to the filling layer 4.

Preferably the containment layer 5 is made of a polymeric material selected from the group comprising: polyolefins, copolymers of different olefins, unsaturated olefin/ester copolymers, polyesters, polycarbonates, polysulphones, phenolic resins, ureic resins, and mixtures thereof. Examples of suitable polymers are polyethylene (PE), in particular low density PE (LDPE), medium density PE (MDPE), high density PE (HDPE) and linear low density PE (LLDPE); polypropylene (PP); elastomeric ethylene-propylene copolymers (EPR) or ethylene-propylene-diene terpolymers (EPDM); natural rubber; butyl rubber; ethylene/vinyl ester copolymers, for example ethylene/vinyl acetate (EVA); ethylene/acrylate copolymers, in particular ethylene/methyl acrylate (EMA), ethylene/ethyl acrylate (EEA), ethylene/butyl acrylate (EBA); ethylene/α-olefin thermoplastic copolymers; polystyrene; acrylonitrile-butadiene-styrene resins (ABS); halogenated polymers, in particular polyvinyl chloride (PVC); polyurethane (PUR); polyamides; aromatic polyesters, such as polyethylene terephthalate (PET) or polybutylene terephthalate (PBT), and copolymers, or mechanical mixtures thereof.

More preferably said containment layer is made of HDPE having a density of at least 0.940 g/cm$^3$ and more preferably between 0.940 and 0.960 g/cm$^3$, or of MDPE having a density preferably comprised between 0.926 and 0.940 g/cm$^3$.

In general the thickness of the containment layer is a compromise solution between two opposing trends. In fact, on the one hand it is desirable that said thickness should be sufficiently great to guarantee a satisfactory containment effect for the underlying polymeric material during the expansion step of the latter, while on the other hand it is desirable that it should be sufficiently small to: a) not prejudice the expansion of the material constituting the filling layer as a result of exerting a crushing action on the latter, b) keep down the costs of the covering and therefore of the cable as a whole, and finally c) allow rapid cooling of the external surface of said filling layer. In respect of the latter point it is in fact necessary to emphasise that at the end of the co-extrusion step of the filling layer/containment layer, the semi-finished cable so obtained is subjected to a cooling operation, generally by passage through a cooling trough containing a cooling liquid. Where the containment layer is of great thickness, aid layer requires a long cooling time and, in particular, cooling of the inner portion of the covering, that is the portion of the layer in contact with the expanded filler, is disadvantageously delayed. This may therefore result in a reduced sealing, i.e. containment, effect by said layer on said expanded polymeric material with the undesired consequence that the latter tends to expand more where there is more space available to do so, giving rise to the formation of a transverse cross section with an irregular profile, of the non-circular type.

Generally the thickness of said containment layer is comprised between 0.1 mm and 1.5 mm, preferably between 0.2 mm and 1.0 mm, more preferably between 0.5 mm and 0.7 mm.

However it should be emphasised that the optimum thickness of said containment layer remarkably depends on the cross section of the cable to be produced and on the volume of expanded polymeric material present within the interstitial zones.

In accordance with the embodiment of the invention illustrated in FIG. 1, the tripolar cable 10 further comprises a layer 6 of expanded polymeric material arranged in a position which is radially external to the containment layer 5, said layer 6 performing the function of conferring to the cable 10 an optimum mechanical strength against accidental impacts as described in document WO 98/52197 mentioned above.

The expandable polymeric material used to obtain both the filling layer 4 and the further layer 6 arranged in a position radially external to the latter is advantageously selected from the group mentioned above. However, it is preferable that the expandable polymeric material to be used in the filling layer 4 is selected from an olefin polymer or copolymer based on ethylene, while the expandable polymeric material to be used in the further layer 6 is selected from an olefin polymer or copolymer based on propylene.

Finally, in accordance with the embodiment illustrated in FIG. 1, the cable 10 according to the present invention is provided with an external polymeric sheath 7 in a position radially external to the layer 6 of expanded polymeric material, said sheath 7 performing the function of external mechanical protection for the cable 10.

In general, said external sheath 7 is made of a polymeric material selected from the group comprising: low density polyethylene (LDPE) (d=0.910-0.926 g/cm$^3$); ethylene copolymers with α-olefins; polypropylene (PP); ethylene/α-olefin rubbers, in particular ethylene/propylene rubbers (EPR), ethylene/propylene/diene rubbers (EPDM); natural rubber; butyl rubbers, and mixtures thereof.

As described above, the embodiment of the invention illustrated in FIG. 1 provides that a layer of, expanded polymeric material and an external sheath are arranged in succession in a position radially external to the containment layer.

However it is worthwhile emphasising that the present invention is also advantageously applicable to cables provided with a form of construction of the conventional type.

Therefore, the application of a metal reinforcement and an external protective sheath, in succession, in a position which is radially external to the containment layer according to the present invention, can also be envisaged.

Further measures are known to the skilled in the art who will be able to evaluate the most appropriate arrangement on the basis, for example, of the costs, of the way the cable is laid (overhead, placed in ductings, buried directly in the ground, within buildings, below the sea, etc.) and of the cable operating temperature (maximum and minimum temperatures, temperature variations in the environment).

As regards the manufacturing process of a multipolar cable, said process generally comprises an initial step designed to produce the cores as defined above, the complexity of said step differing from case to case depending upon the type of cable to be produced.

For example, considering the production process for a multipolar cable for the transport or distribution of low voltage electrical power, in general each core is obtained by unwinding a conductive element from a suitable feed spool and applying a layer of electrical insulation to the latter, typically by extrusion. Said layer is preferably obtained from a polyolefin, in particular polyethylene, ethylene-propylene copolymers and the like. At the end of said extrusion step the layer of electrical insulation is preferably subjected to a cross-linking operation in accordance with known techniques, for example by using peroxides, or silanes. Once completed, the core so obtained is then stored on a suitable collection spool.

On the contrary, when the production process for a multipolar cable for the transport or distribution of medium voltage electrical power is considered, in general each core is obtained by unwinding a conductive element from a suitable feed spool and by applying to the latter respectively an internal semiconductive layer, a layer of electrical insulation and external semiconductive layer by known means, in particular through a plurality of consecutively performed extrusions. Alternatively, the application of the aforesaid inner and external semiconductive layers and of the layer of electrical insulation can be obtained through a co-extrusion process in accordance with known techniques. The assembly so obtained is then stored on a first collection spool and a metal screen is subsequently applied to said assembly in accordance with known means, generally on a different line of the production plant. For example, said metal screen can be produced by using a tape screening machine which positions thin tapes of copper (for example of a thickness of approximately 0.1-0.2 mm) helicoidally, by means of appropriate rotating heads, preferably overlapping the edges of said tapes by about 33% of their surface area. As an alternative, said metal screen can be made up of a plurality of copper wires (for example of diameter 1 mm) unwound from spools positioned in suitable rotating cages and applied helicoidally to the assembly mentioned above. In general, in said circumstances it is also necessary to apply a counterspiral (for example a copper tape having a thickness of approximately 0.1-0.2 mm) which performs the function of holding the above copper wires in position during the subsequent manufacturing steps. The core so obtained is then stored on a second collecting spool.

As already mentioned, once said cores have been obtained they are twisted together to form an assembled element by using techniques known in the art, for example by using a combining machine. In general, said machine comprises a rotating unit on which the spools containing the individual cores of the cable are mounted, said spools being arranged in a number equal to the number of cores of the multipolar cable to be produced. The rotation of the rotating unit and the simultaneous pulling of the aforesaid cores causes them to be wound together helicoidally, while the choice of either the rotation speed of the rotating unit or the linear speed at which the cores are pulled makes it possible to set the desired pitch for said twisting.

As far as the manufacturing process of a cable according to the present invention is concerned, the main steps characterizing the aforesaid process in the case where it is desired to manufacture the tripolar cable 10 illustrated in FIG. 1 are described hereinbelow. Where it is desired to manufacture a multipolar cable other than a tripolar cable, for example a quadripolar cable, the process described for the tripolar cable 10 can be suitably modified on the basis of the information provided and the technical knowledge possessed by an average person skilled in the art.

As mentioned above, each core of the cable is obtained by unwinding a conductive element 1 from a suitable feed spool and applying a layer of electrical insulation 2 to the latter, generally by extrusion. At the end of said extrusion step, the material of the electrical insulation layer 2 is preferably cross-linked in accordance with known techniques, for example by using peroxides or silanes. Alternatively, the material of the electrical insulation layer can be of the thermoplastic type, that is not cross-linked, so as to ensure that the material is recyclable. Once completed, each core is stored on a first collection-spool.

The assembled element 20, which in the embodiment shown in FIG. 1 comprises three separate cores, is then manufactured. Said assembled element 20 is obtained by using a combining machine which, as mentioned above, at the same time winds and rotates the cores stored on three separate collecting spools in order to twist them together helicoidally according to a predetermined pitch. Once obtained, the assembled element 20 is stored on a second collection spool.

The filling layer 4 and the containment layer 5 according to the present invention are then applied. In greater detail, the assembled element 20 is unwound from the aforesaid second collecting spool in accordance with any known technique, for example by using a pulling capstan designed to provide continuously and regularly said assembled element 20 to an extrusion device. It is in fact desirable that the pulling action should be constant over time so that said assembled element 20 can move forward at a predetermined speed so as to ensure a uniform extrusion of the layers 4, 5 mentioned above.

Preferably the assembled element 20 is delivered within an extrusion equipment provided with a double layer extrusion head, said equipment comprising two separate extruders flowing into a common extrusion head so as to respectively deposit the filling layer 4 and the containment layer 5 on the assembled element 20 by co-extrusion.

Figure 2:
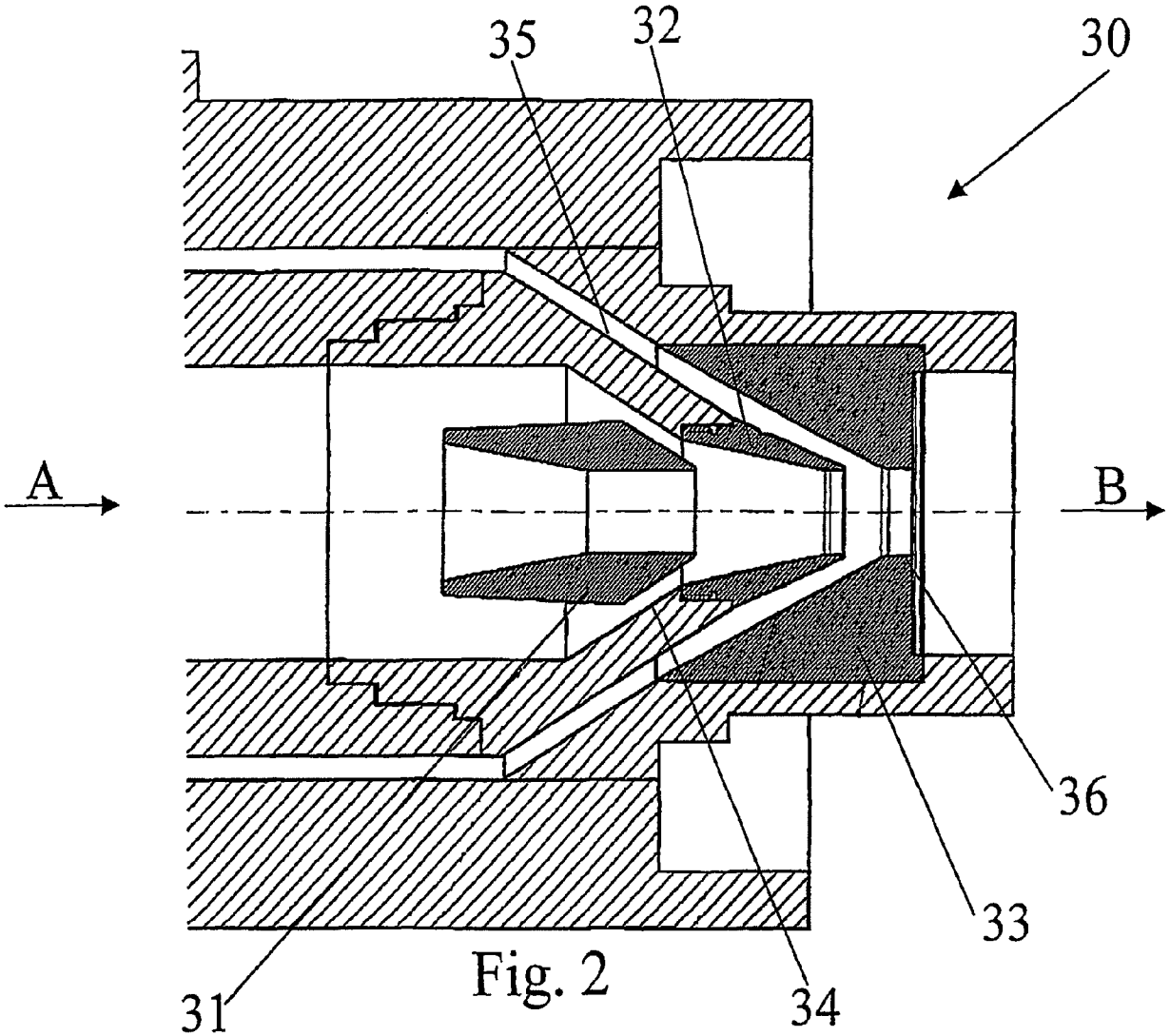
FIG. 2 is a view in longitudinal cross section of a detail of the extrusion equipment of the cable shown in FIG. 1.

In detail, FIG. 2 shows a partial view in longitudinal cross section of a double layer extrusion head 30 of an extrusion equipment known per 1-se, and therefore not shown in its entirety.

Said double layer extrusion head 30 comprises a male die 31, an intermediate die 32 and a female die 33. Said dies are arranged in the aforesaid sequence, concentrically overlapping each other and radially extending from the axis of the assembled element 20.

More particularly, arrow A indicates the direction of advance of the assembled element 20, in a position radially external to which the filling layer 4 is extruded through the conduit 34 provided between the male die 31 and the intermediate die 32. The containment layer 5 is extruded in a position radially external to the filling layer 4 through the conduit 35 which is located between the intermediate die 32 and the female die 33. Arrow B indicates the exit direction for the assembly of the assembled element 20, the filling layer 4 and the containment layer 5 for the cable 10 of FIG. 1.

Therefore, at the same time as the assembled element 20 is unwound, the expandable polymeric composition used in the filling layer 4 and the polymeric composition used in the containment layer 5 are separately fed to the inlet of each extruder in a known way, for example by using two separate hoppers.

Each polymeric composition can incorporate a pre-mixing step of the polymeric base with other components (fillers, additives or others), said pre-mixing step being performed in an equipment upstream from the extrusion process, such as for example an internal mixer of the tangential rotor type (Banbury) or with interpenetrating rotors, or in a continuous mixer of the Ko-Kneader (Buss) type or of the type having two co-rotating or counter-rotating screws.

Each polymeric composition is generally delivered to the corresponding extruder in the form of granules and plasticized, that is converted into the molten state, through the input of heat (via the external cylinder of the extruder) and the mechanical action of a screw which works the polymeric material and presses it into the corresponding extrusion duct towards the outlet of each duct to form the desired coating layer.

The operation of extruding the filling layer 4 takes place directly on the assembled element 20 and the step of expansion of the polymeric material of said filling layer 4 is performed during the extrusion operation as described in document WO 98/52197 cited above. Said expansion can take place either by chemical means, through the addition of a suitable expanding agent during the step of preparing the polymeric composition, which is capable of producing a gas under specific temperature and pressure conditions, or by physical means, by injecting gas at high pressure directly into the cylinder of the extruder. Examples of suitable expanding agents are: azodicarbamide, paratoluene sulphonylhydrazide, mixtures of organic acids (citric acid for example) with carbonates and/or bicarbonates (sodium bicarbonate for example), and the like. Examples of gases which can be injected into the extruder cylinder at high pressure are: nitrogen, carbon dioxide, air, low boiling point hydrocarbons, for example propane or butane, halogenated hydrocarbons, for example methylene chloride, trichlorofluoromethane, 1-chloro-1,1-difluoroethane, and the like, or mixtures thereof.

It has been observed that under the same extrusion conditions (such as screw rotation speed, speed of the extrusion line, diameter of the extruder head), one of the process variables which most greatly influences the expansion degree is the extrusion temperature. In general, at extrusion temperatures below 130° C. it is difficult to obtain a sufficient expansion degree; the extrusion temperature is preferably at least 140° C., in particular approximately 180° C. Normally a greater expansion degree corresponds to an increase in the extrusion temperature.

It is also possible to control the expansion degree of the polymer to some extent by acting on the cooling rate. In fact the expansion degree of said polymeric material can be increased or decreased by suitably delaying or advancing the cooling of the polymer forming the expanded coating at the outlet from the extruder.

In accordance with the present invention, the expansion degree of the polymeric material of said filling layer can vary from 5% to 500%, preferably from 10% to 300%, and more preferably between 20% and 200%.

In accordance with the present invention, as will be made more clear by the examples which follow, the die used for the extrusion of the containment layer 5 is preferably provided with an extension 36 arranged coaxially with respect to the assembled element 20.

Preferably said extension has a length comprised between 1 mm and 20 mm, preferably between 2 mm and 10 mm, and more preferably between 2 mm and 5 mm.

Said extension performs the function of guiding the containment layer on the underlying filling layer and keeping said containment layer pressed upon the filling layer for a sufficiently long distance, and therefore a sufficiently long period of time, so as to contain the expansion of the filling layer to the desired amount.

The assembly of assembled element 20, filling layer 4 and containment layer 5 leaving the double layer extrusion head 30 is generally subjected to a cooling cycle. Said cooling is preferably achieved by moving said assembly within a cooling trough containing a suitable fluid, typically well water or water cooled to a temperature of approximately 12-15° C.

Downstream from the aforesaid cooling cycle said assembly is generally subjected to drying, for example by means of air blowers, and successively collected on a third collecting spool.

In order to obtain the cable 10 illustrated in FIG. 1, the aforesaid production process also comprises a further line where the assembly of assembled element 20, filling layer 4 and containment layer 5 is unwound from the aforesaid third collecting spool and fed to a successive extrusion equipment designed to apply the layer 6 of expanded polymeric material in a position radially external to the containment layer 5.

In the same way as described for the filling layer 4 cited above, the expansion step of the expandable polymeric material of the aforesaid layer 6 is performed during the extrusion step of said layer through similar means to those mentioned above and described in the previously cited document WO 98/52197.

The layer 6 of expanded polymeric material is then subjected to a suitable cooling step in accordance with similar means to those mentioned above.

In accordance with a further embodiment, said layer 6 is extruded in the same unit which applies that filling layer 4 and the containment layer 5 downstream from the step in which said layers 4, 5 are cooled, with no third collecting spool being therefore necessary.

Finally, the cable 10 shown in FIG. 1 is finished off with the deposition of an external polymeric sheath 7 positioned over said layer 6 of expanded polymeric material and produced, for example, by extrusion.

The cable 10 so obtained is successively wound onto a final collecting spool and delivered to a storage section.

Some illustrative examples are provided below in order to provide further description of the invention.

Example 1

A tripolar low voltage cable was manufactured by using the method of construction illustrated in FIG. 1.

In greater detail, for the purposes of the present invention, the manufacture of only the assembly of assembled element 20, filling layer 4 and containment layer 5 of said tripolar cable 10 was realized in accordance with the embodiment illustrated in FIG. 1.

Each of the three cores of said cable presented a copper conductive element (of cross section 16 $mm^2$) coated, in an extrusion line, with an insulating layer based on polyethylene cross-linked with silanes, in a thickness of 0.7 mm.

Said cores (each having an external diameter of approximately 6.4 mm) were subjected to a combining operation as described above with left-hand helicoidal winding with a pitch of 313 mm to form the assembled element 20.

Successively a filling layer 4 of expanded polymeric material and a containment layer 5 of said filling layer was deposited by co-extrusion in a position radially external to said assembled element 20.

In greater detail, said filling layer was obtained by extruding Riblene FL30® (low density polyethylene produced by Polimeri Europa).

The expansion of said filling layer was achieved by chemical means, by adding to the hopper 1.5% by weight (with respect to the whole) of Hydrocerol® BIH 40 expanding agent (carboxylic acid/sodium bicarbonate), manufactured by Boehringer Ingelheim.

The material of the filling layer had a final density of 0.45 $kg/dm^3$ and an expansion degree of approximately 100%.

The thickness of said filling layer was equal to approximately 0.2 mm in the portion radially external to the assembled element 20, that is on the extrados of the latter. A Bandera 30 mm single screw extruder in configuration 20 D was used to deposit the filling layer.

A containment layer 5 was deposited by co-extrusion with said filling layer as explained above in the present description. In more detail said containment layer was obtained by the extrusion of DGDA 6318® (medium density: polyethylene, manufactured by Union Carbide).

Said covering layer had a thickness of 0.7 mm and the extrusion was performed by using a Bandera 80 mm single screw extruder in configuration 20 D.

The heat profile and the operating parameters of the extruder used to obtain the filling layer and the containment layer are shown in Tables 1 and 2.

TABLE 1

| Extruder zone | Extruder of the filling layer (° C.) | Extruder of the containment layer (° C.) |
|---|---|---|
| Zone 1 | 160 | 180 |
| Zone 2 | 180 | 190 |
| Zone 3 | 200 | 200 |
| Zone 4 | / | 210 |

TABLE 1-continued

| Extruder zone | Extruder of the filling layer (° C.) | Extruder of the containment layer (° C.) |
|---|---|---|
| Extruder/head connection flange | 220 | 220 |
| Head | 220 | |

TABLE 2

| Size | Filling layer extruder | Containment layer extruder |
|---|---|---|
| Male die diameter | 14.5 mm | |
| Female die diameter | 14.7 mm | |
| Diameter of the cable at the end of the step | 15.6 mm | |
| Extruder screw speed | 0.3 rpm | 22 rpm |
| Extrusion line speed | 2.5 m/min | |

The semi-finished cable obtained so far was subjected to optical analysis to check the expansion degree of the polymeric material forming the filling layer.

The results obtained were very satisfactory since the external surface of the aforementioned cable had a substantially smooth appearance and in particular had an external perimetral profile in its transverse cross section of substantially circular shape.

Example 2

Comparison

By using a manufacturing process similar to that described in Example 1, a tripolar low voltage cable similar to that illustrated in FIG. 1 was manufactured, but without the containment layer 5.

By using similar means to those in Example 1, and under the same operating conditions as in Example 1, the assembled element 20 was obtained and a filling layer 4 was successively applied by extrusion to the radially external portion thereof.

The semi-finished cable so obtained was then subjected to optical analysis which showed that the appearance of the external surface of said cable was particularly rough and the transverse cross section of its external perimetral profile was non-circular, with lacerations in that layer.

The present invention has some major advantages in comparison with the known art.

In the first place the application of a containment layer in a position radially external to the filling layer makes it possible to obtain a multipolar cable having a substantially circular cross section, a fact which is particularly desirable since it prevents the occurrence of a plurality of disadvantages as mentioned above.

In the second place, the development of a production process which is capable of providing for a multipolar cable provided with a filling layer of expanded polymeric material within the interstitial zones of the cable makes it possible to confer a greater lightness upon the latter in comparison with similar multipolar cable structures in which the interstitial zones are filled with a conventional filling material. As already mentioned, said greater lightness ensures that the cable is easier to handle, particularly during installation, and reduces the costs of transport, installation and of the product itself.

Furthermore, the use of the aforesaid expanded material confers less flexural rigidity to the multipolar cable and this again is reflected in easier handling of the cable both during storage, for example when winding/unwinding spools, and during installation.

A further advantage is also provided by the improved mechanical protection against impacts for the cores of the multipolar cable which the expanded filling material is able to ensure in comparison with a filling material of the conventional type. It is in fact worth pointing out that the expanded polymeric material is capable of absorbing impacts due to the environmental conditions to which the cable is subjected, particularly during laying. Because of the nature of the material, said expanded polymeric material in fact absorbs impacts effectively and substantially reversibly, thus ensuring appreciably better performance than a conventional filling. The latter in fact, being more rigid, in addition to undergoing permanent deformation (failing to reacquire its initial shape once the cause of its deformation is no more present), transmits almost all the force of the impact to the underlying layers.

The invention claimed is:

1. A multipolar cable, wherein said multipolar cable is produced by a process comprising:

a) providing a plurality of cores, wherein each of said cores comprises at least one conductive element and at least one layer of electrical insulation in a position radially external to said at least one conductive element;

b) twisting said plurality of cores together so as to form an assembled element having a plurality of interstitial zones between said cores; and c) depositing by co-extrusion:

an expandable polymeric material in a position radially external to said cores so as to fill said plurality of interstitial zones and to form a filling layer of substantially circular transverse cross section, wherein said expandable polymeric material is expanded during said deposition, and at least one containment layer of polymeric material in a position radially external to said filling layer.

2. The multipolar cable according to claim 1, further comprising at last one further layer of expandable polymeric material in a position radially external to said containment layer.

3. The multipolar cable of according to claim 2, wherein said expandable polymeric material of said filling layer, said polymeric material of said containment layer, and said expandable polymeric material of said further layer located in a position radially external to said containment layer are selected separately from each other from polyolefin polymers or copolymers based on ethylene and/or propylene.

4. The multipolar cable according to claim 1, wherein said filling layer has a degree of expansion ranging from about 5% to about 500%.

5. The multipolar cable according to claim 4, wherein said filling layer has a degree of expansion ranging from about 20% to about 150%.

6. The multipolar cable according to claim 4, wherein said further layer has a degree of expansion ranging from about 5% to about 500%.

7. The multipolar cable according to claim 6, wherein said further layer has a degree of expansion ranging from about 20% to about 150%.

8. The multipolar cable according to claim 1, wherein the thickness of said at least one containment layer ranges from about 0.1 to about 1.5 mm.

9. The multipolar cable according to claim 8, wherein said thickness ranges from about 0.5 to about 0.7 mm.

* * * * *